US006065872A

United States Patent [19]

Johnson

[11] Patent Number: 6,065,872

[45] Date of Patent: May 23, 2000

[54] PINCH AND PULL OPEN RECLOSABLE BAG AND ZIPPER THEREFOR

[75] Inventor: James R. Johnson, Chamblee, Ga.

[73] Assignee: Illinois Tool Works Inc., Glenview, Ill.

[21] Appl. No.: 09/244,519

[22] Filed: Feb. 4, 1999

[51] Int. Cl.[7] ..... B65D 33/16

[52] U.S. Cl. ..... 383/63; 24/576; 24/587

[58] Field of Search ..... 383/63, 64, 65; 24/587, 576

[56] References Cited

U.S. PATENT DOCUMENTS

| | | | |
|---|---|---|---|
| 5,238,306 | 8/1993 | Heintz et al. | 383/61 |
| 5,366,294 | 11/1994 | Wirth et al. | 383/65 X |
| 5,540,366 | 7/1996 | Coomber | 383/61 X |
| 5,638,586 | 6/1997 | Malin et al. | 383/63 X |
| 5,655,273 | 8/1997 | Tomic et al. | 383/63 X |
| 5,709,915 | 1/1998 | Tomic et al. | 383/63 X |

*Primary Examiner*—Jes F. Pascua
*Attorney, Agent, or Firm*—Pitney, Hardin Kipp and Szuch LLP

[57] ABSTRACT

A recloseable package is disclosed having a front wall and a rear wall. A thermoplastic zipper male base member is disposed at a top end of the first wall and a thermoplastic zipper female base member is disposed at a top end of the second wall. The base members each have a profile which extends transversely across the walls. The profiles are each disposed between a product side web and a consumer side web. A heat resistant barrier is provided on facing surfaces of the male and female product side webs, extending from product side longitudinal edges of the base members toward the associated profiles. The male and female base members are heat sealed to the first and second walls, respectively, opposite to the heat resistant barriers which are resistant to heat sealing to each other. The facing surfaces of the consumer side webs may likewise have heat resistant barrier layers, in which case the package is sealed above the consumer side webs. Alternatively, the facing surfaces of the consumer side webs may be provided with peel seal layers which fuse together when the consumer side webs are heat sealed to the bag walls, thereby forming a top seal for the package. A zipper for use in the disclosed package is also disclosed.

14 Claims, 4 Drawing Sheets

PINCH AND PULL OPEN RECLOSABLE BAG AND ZIPPER THEREFOR

BACKGROUND OF THE INVENTION

The present invention relates to plastic bags and packages of the type in which food products are packaged for sale to consumers. More particularly the present invention relates to recloseable zippered packaging that is of a type that is particularly well suited for use for products such as chips and other salty snacks. Such packages are conventionally formed of a laminated plastic film material, the various plies of the laminate having desired barrier and other properties to protect the bag contents and provide a handsome package.

The conventional non-zippered chip package is designed to enable the consumer to open the package by gripping the front and rear walls of the package with thumb and forefinger of each hand, pinching some of the wall on each side of the bag inside the thumb and forefinger, and simply pulling the walls apart. This results in a de-lamination of the bag at the top seal, pulling the top seal apart and thereby providing access to the contents of the bag through the open top. Such bags are designed to delaminate with approximately 800 grams of pull force.

The benefits of adding a zipper feature to such packaging is readily apparent. One of the most obvious benefits being that any unused portion of the bag may be easily stored and protected simply by closing the zipper after initially opening the package. The problem encountered, however, is that the pull force necessary to delaminate the top seal, when applied to the package below the zipper, tends to delaminate the zipper from the bag walls, rendering the zipper useless. The addition of a zipper to such packaging has thus required that the packaging be designed to require the user to depart from the conventional "pinch and pull" technique of initially opening the sealed package with which the public has become acquainted. As a result, zippered packaging has met with only limited success for chips and other similar products, due, at least in part, to the reluctance of producers to sacrifice the accepted "pinch and pull" opening feature of the packaging in favor of a reclosable feature.

SUMMARY OF THE INVENTION

In view of the above, it is a principal object of the present invention to provide an improved zippered package, the top seal of which may be delaminated open by the "pinch and pull" technique used to open conventional laminated packaging.

A further object is to provide such a package in which the zipper will remain secured to the package walls notwithstanding an application of a force to the package, below the zipper profiles sufficient to delaminate the top seal of the package above the zipper profiles.

A further object is to provide a zipper, the configuration of which is such as to enable the zipper to remain bonded to the bag wall even when subjected to the pull force required to delaminate the top seal of the package.

The above and other beneficial objects and advantages are attained in accordance with the present invention by providing a zipper for attachment to the laminated material from which the package is to be formed. The zipper includes a longitudinally extending thermoplastic male base member having a co-extensive male profile protruding from one surface thereof which is disposed between a product side web (i.e. directed toward the bag bottom) and a consumer side web (i.e. directed toward the bag top). Likewise, a longitudinally extending thermoplastic female base member has a co-extensive female profile protruding from one surface thereof which is disposed between a product side web and a consumer side web. The male and female profiles are configured to interlock with each other. Each of the male and female base member product side webs extend substantially to the same extent with each other from a product side edge of its associated base member toward its associated profile. The product side webs each have a heat resistant barrier layer disposed on the surface from which its profiles protrude but not on the opposite surface. Thus, when the zipper product side webs are heat sealed to the bag film material, the barriers prevent the product side webs from sealing to one another as the product side webs are sealed to the bag material.

In one embodiment of the present invention the consumer side webs of both the male and female base members are also provided with heat resistant barrier layers on the sides from which the profiles protrude. The barrier layers extend to the same extent from the associated consumer side edges of the base members toward the profiles so that when the zipper is heat sealed to the bag film above the profiles, the barriers prevent the consumer side webs from sealing to one another. In this case, the zipper is attached below the top edge of the bag and the front and back walls of the laminated bag material are sealed to one another above the zipper to form the bag's top seal. A consumer's "pinching and pulling" of the bag walls delaminates the bag film at the top seal, above the zipper, permitting the bag to open in the conventional manner.

In a second embodiment the consumer side webs of the both the male and female base members are provided with a peel seal layer on the side from which the profiles protrude. In this case the zipper is attached at the top of the bag so that when the consumer side webs are attached to the front and back walls of the bag material the peel seals are fused to one another forming the top seal for the bag. A consumer's "pinching and pulling" of the walls of this bag ruptures the peel seal, causing the bag to open with the "feel" of the opening of a conventional chip bag.

The bags of both embodiments may conveniently be formed in the manner disclosed in U.S. Pat. No. 4,909,017. In accordance with this patent the zipper is applied transversely to the running direction of the film toward the filling tube of a form, fill and seal machine. Prior to the complete scaling of both halves of the zipper to the bag material, only half of the zipper is attached to the bag making film. The other half of the zipper is held only by the interlocking of the profiles. As the bag material, with its partly attached zipper, passes over the forming collar of the machine (which transforms the flat film into a tubular shape) there is a tendency for the profiles to disengage causing the zipper halves to separate. The zipper of the present invention may be treated to assist in overcoming this tendency by electrostatically charging the product side webs to attract to one another. This statically holds the zipper parts in place as the bag film passes over the forming collar.

BRIEF DESCRIPTION OF THE DRAWINGS

The present invention will now be described in more detail with reference being made to the accompanying drawings wherein.

DETAILED DESCRIPTION OF THE PREFERRED EMBODIMENTS

Figure 1:
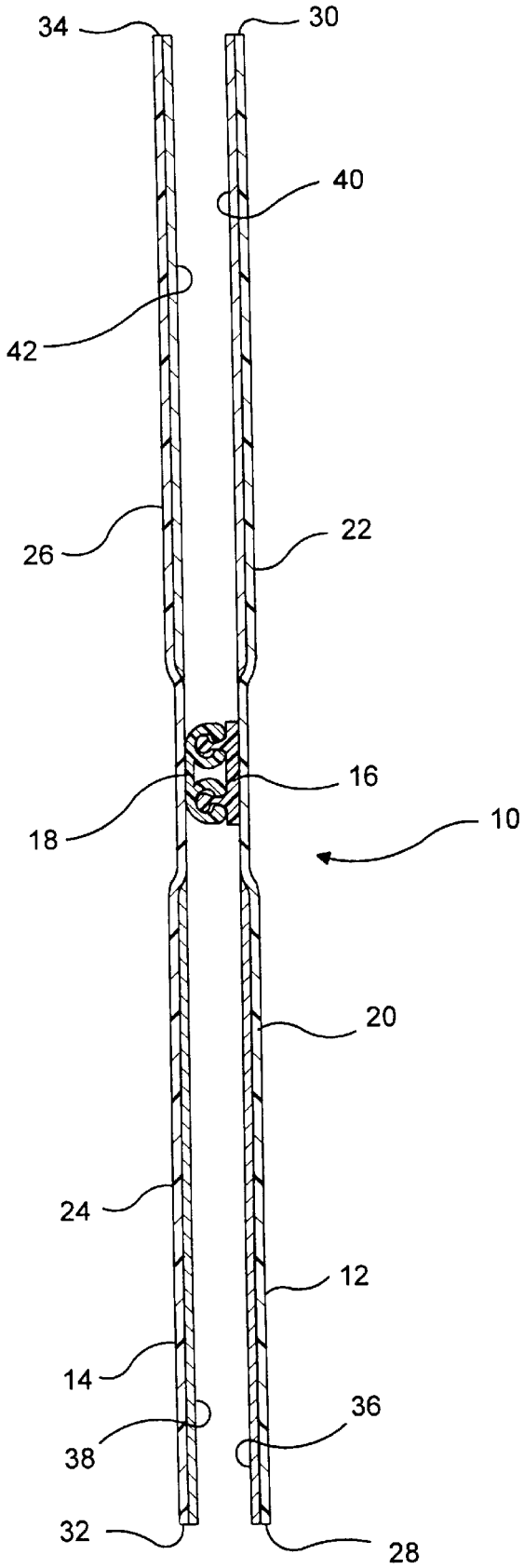
FIG. 1 is a side elevational view of a reclosable zipper strip in accordance with a first embodiment of the present invention.

Reference is now made to the drawings and to FIG. 1 in particular wherein a first embodiment of a zipper 10 is depicted. The zipper 10 includes a male base member 12 and a female base member 14. The base members are preferably formed of a thermoplastic material such as polyethylene. A male profile 16 protrudes from a central portion of male base member 12 and a female profile 18 protrudes from a central portion of the female base member 14. The profiles each include double engaging elements that are configured to engage with one another. Generally the side of the engaged profiles designed to face the product requires a greater pull force to disengage the profiles then the side of the engaged profiles that face the consumer. This renders the reclosable bag somewhat easier to open from the outside then the inside. The difference in the required opening force from the bag inside and bag outside may be minimized to render the profiles "bi-directional". Each of the base members includes two webs extending in opposite directions away from the associated profile. Thus male base member 12 includes product side web 20 which extends from a product side edge 28 toward the center of the male base member and consumer side web 22 which extends from a consumer side edge 30. Likewise female base member 14 includes product side web 24 which extends from a product side edge 32 and consumer side web 26 which extends from a consumer side edge 34. The male and female product side webs are substantially the same size as are the male and female consumer side webs.

A heat resistant barrier layer 36 is provided on the male product side web extending to the male profile 16 from the product side edge 28 on the surface directed toward the female product side web. Similarly a heat resistant barrier layer 38 is provided on the female product side web extending to the female profile 18 from the product side edge 32 on the surface directed toward the male product side web. Likewise, barrier layers 40 and 42 are provided on the facing surfaces of the consumer side webs 22 and 26, extending from the consumer side edges 30 and 34 respectively toward the male and female profiles 16, 18. The barrier layers 36, 38 and 40, 42 may, for example, comprise a heat insulating ink printed onto the base material which prevents the surfaces of the webs that face each other from fusing to one another when the sealing jaws of an associated bag making machine seal the surfaces of the webs, that face away from the profiles, to the walls of the bag being formed. Alternatively, the barrier layers 36, 38 and 40, 42 could constitute a layer of higher melt material co-extruded with or laminated onto the base material. Also, if the barrier layer offers sufficient heat resistance, only one of the barrier layers 36 and 38 and one of the barrier layers 40 and 42 may be sufficient.

Figure 2:
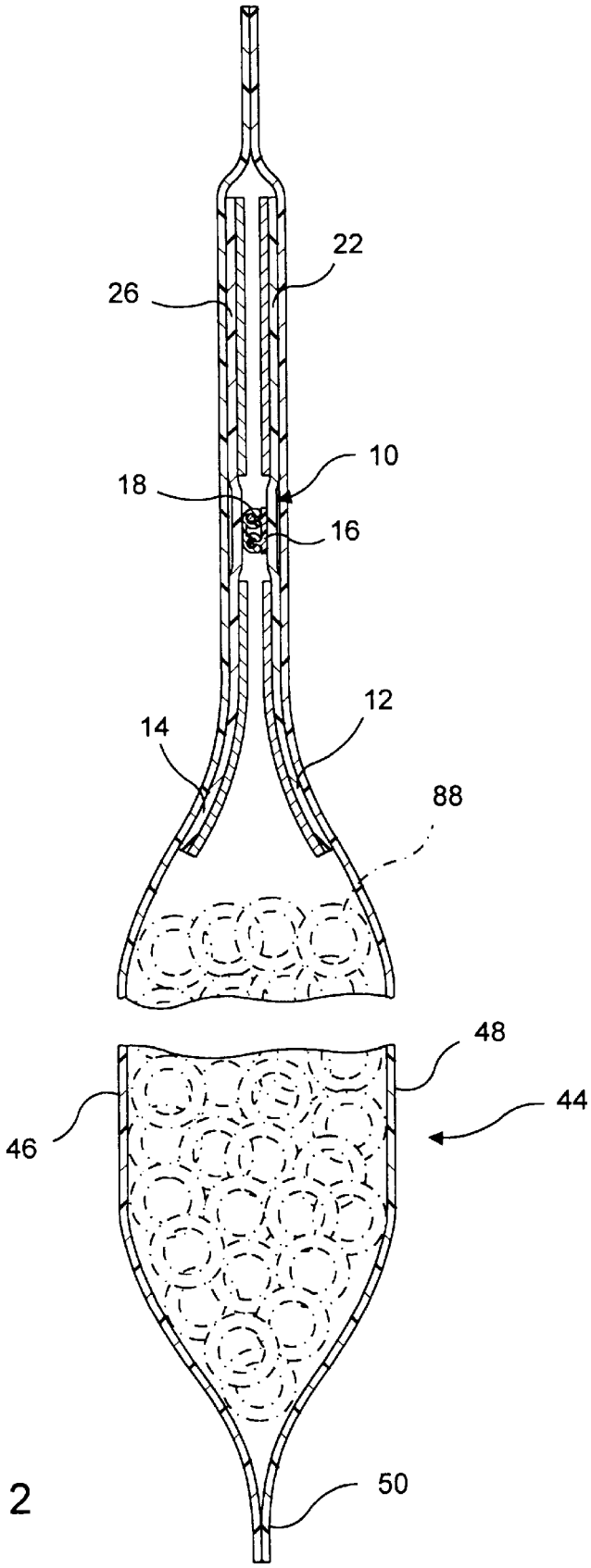
FIG. 2 is a side sectional view of a reclosable bag incorporating the zipper of FIG. 1.

Reference is now made to FIG. 2 wherein a bag 44 is depicted having front and rear walls 46 and 48, respectively. The bag walls are formed of a multi-ply laminate as is customarily used for chips and similar snack foods. As will be noted in FIG. 2, the product and consumer side webs 20, 24 and 22, 26 of zipper 10 are sealed to the front and rear walls of the bag below and above the male and female profiles 16 and 18. The bag walls 46 and 48 are cross sealed to each other at the bag bottom 50 and at the bag top 52 above the zipper 10. As noted above, the bag body is formed of conventional laminated film material. The male and female profiles 16, 18 are preferably designed to separate, from the product side, when subjected to a force on the order of 800 grams which is commensurate with the delaminating force required to delaminate the film material from which the bag is formed. Accordingly, when a consumer seeks to open the bag by the conventional "pinch and pull" method of opening a chip package, the applied force will first separate the profiles from each other (leaving the product side and consumer side webs secured to the bag walls) and then delaminate the bag wall material at the top seal 52 in the ususal fashion. The delamination is only at the top seal, leaving the zipper intact and firmly bonded to the bag walls. The bag 44 will thus have the "feel" of a conventional chip package but with the added benefit of a zipper for subsequent reclosing of the package after its initial opening.

Figure 3:
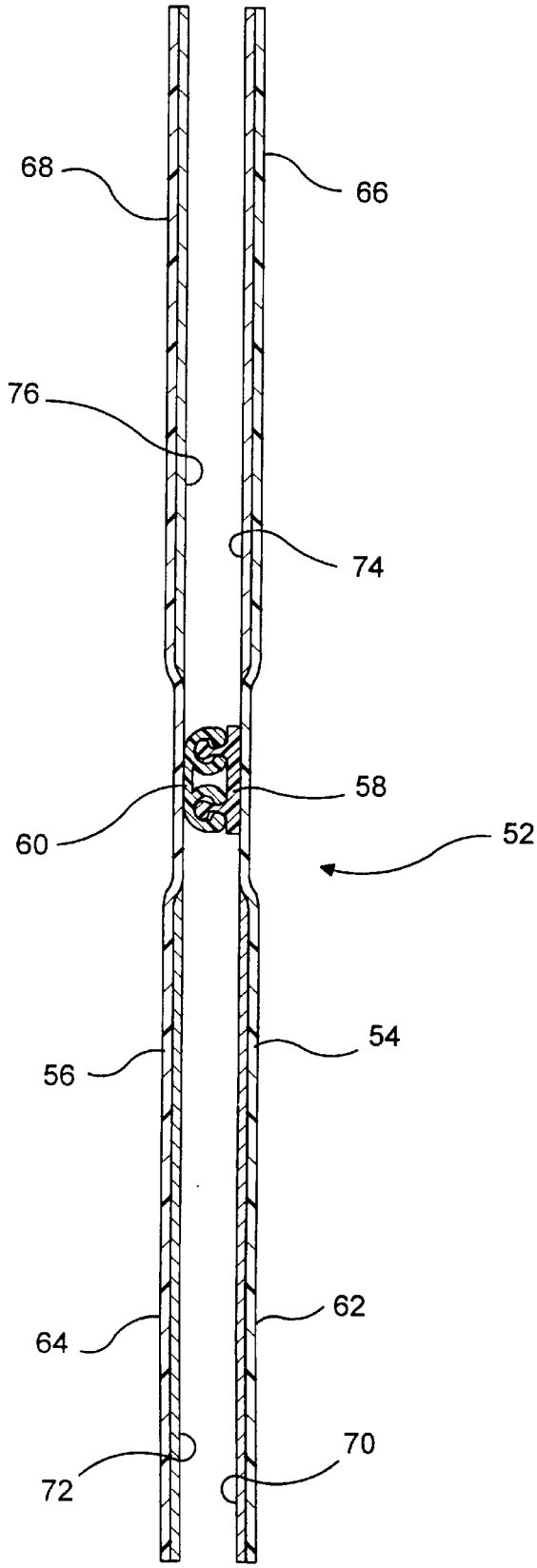
FIG. 3 is a side elevational view of a reclosable zipper strip in accordance with a second embodiment of the present invention; and, FIG. 4 is a side sectional view of a reclosable bag incorporating the zipper of FIG. 3.

An alternative zipper construction in accordance with the present invention is depicted in FIG. 3. In accordance with this embodiment the zipper 52 includes a male base member 54 and a female base member 56. The male and female profiles 58 and 60 protrude from the center portions of the base members 52, 54 surrounded by product side 62, 64 and consumer side 66, 68 webs, as with the first embodiment. Further, as with the first embodiment the product side webs 62, 64 are provided, on the surfaces that face each other, with heat resistant barrier layers 70, 72 which prevent the webs from sealing to each other as the webs are attached to the walls of an associated bag by the sealing jaws of the bag making equipment. In this embodiment the facing surfaces of the consumer side webs are each provided with a peel seal layer 74, 76 rather than the heat barrier layer of the first embodiment. Thus, as the consumer side webs 66, 68 are sealed to the bag walls, the peel seal material of the consumer side webs will fuse forming a peel seal. Preferably, the holding force of the peel seal created by fusing layers 74 and 76 during the bag forming process is approximately equivalent to that of de-laminating force of the material from which the bag is formed, i.e. approximately 800 grams.

Figure 4:
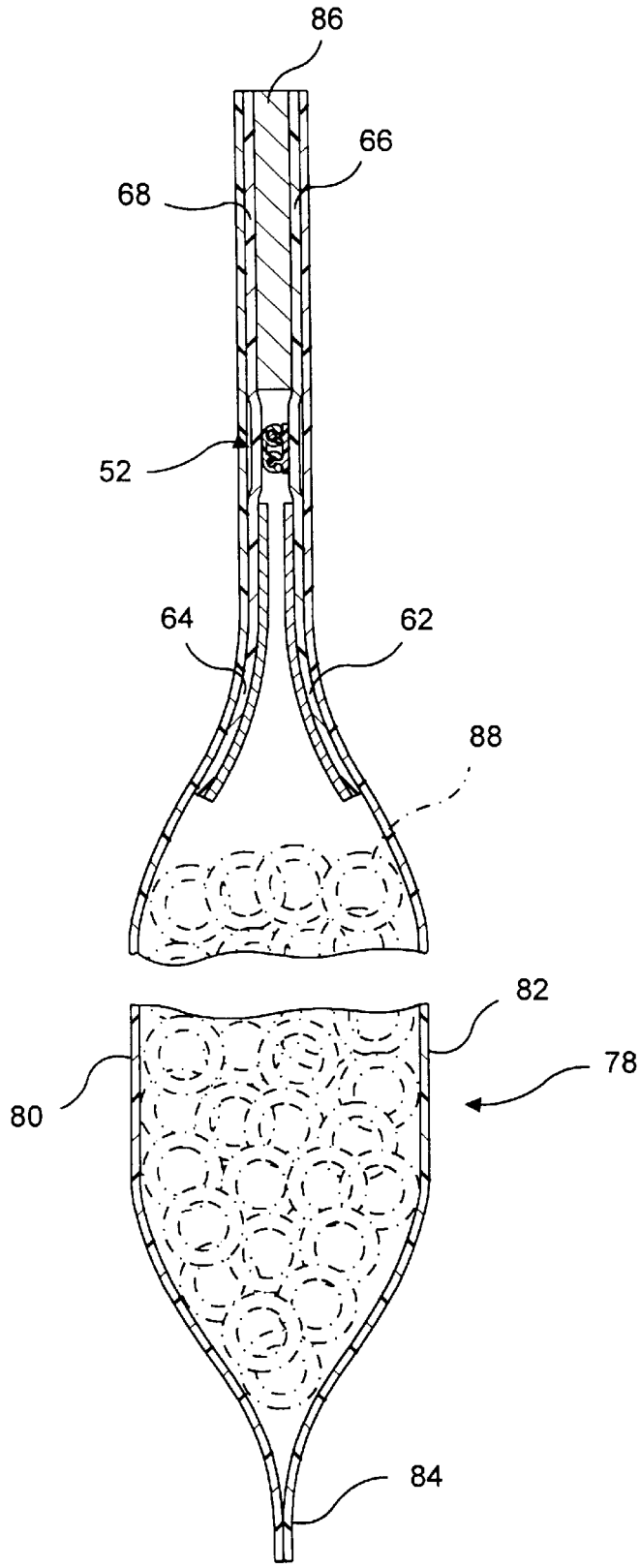

A package 78 incorporating the zipper 52 of FIG. 3 is depicted in FIG. 4. The package of FIG. 4 has front and rear walls 80, 82 and a bottom seal 84. The zipper 52 is position at the top of the package with the product side webs 62, 64 sealed to the rear and front walls 82, 80 of the package, respectively below the male and female profiles. The consumer side webs 66, 68 are also sealed to the rear and front walls 82, 80 of the package, respectively above the male and female profiles.

During the process of sealing the zipper 52 to the package walls, the peel seals 74 and 76 are fused to form a top peel seal 86 for the package. The heat resistant barrier layers on the product side webs prevent the product side webs from fusing to each other. As noted, the peel seal material is preferably selected to rupture when subjected to roughly the same force as required to delaminate a conventional chip package, i.e. approximately 800 grams, which is also the force required to disengage the zipper profiles from the product side. Thus, when a consumer seeks to open the package by the pinch and pull method, the package 82 will have the same "feel" to the consumer as the conventional chip bag.

The packages 44 and 78 may be formed, filled and sealed in accordance with the method and on the equipment that is generally disclosed and described in U.S. Pat. No. 4,909,017, that is, with the zipper 10 extending transversely to the running direction of the film material from which the bag walls are formed. That is, the zipper is applied to the bag film material upstream of a filling tube through which a product 88 is dropped into the bags. En route to the filling tube the material is passed over a forming collar which transforms the flat film material into a tubular shape. Prior to passing the film over the forming collar the zipper is attached to the bag film material transverse to the running direction of the film. Upstream of the forming collar only half of the zipper (i.e. either the male or female side) is attached to the film material, the other half being held in position only by the interlocked profiles, until both halves of the zipper are sealed to the bag film downstream of the forming collar. As the bag material with its partly attached zipper passes over the forming collar of the form fill and seal (FFS) machine, forces may be exerted on the film by the forming collar that tend to separate the zipper halves. These forces, which heretofore were only counteracted by the interlocked profiles, may be further counteracted, to some extent, by treating the leading webs of the zipper that pass over the forming collar (i.e. the product side webs), so as to be electrostatically attracted to one another. The electrostatic attraction working with the interlocked profile serves to maintain the zipper halves in place until they are sealed to the bag material. Accordingly, the heat resistant barrier layers 36, 38 of the FIG. 1 embodiment and the barrier layers 70, 72 of the FIG. 2 embodiment may be further treated, such as by arc discharge, so as to statically cling to one another.

Thus, in accordance with the above, the aforementioned objectives are effectively attained. Modification of the disclosed embodiments would be obvious to those of ordinary skill in the art but would not bring the invention so modified beyond the scope of the appended claims.

Having thus described the invention, what is claimed is:

1. A zipper for a reclosable package, said zipper comprising:

a longitudinally extending thermoplastic male base member having a male profile protruding from one surface thereof disposed between a product side web and a consumer side web; and a longitudinally extending thermoplastic female base member having a female profile protruding from one surface thereof disposed between a product side web and a consumer side web, said female profile being adapted to interlockingly engage with said male profile;

each of said male and female base member product side webs extending from a product side longitudinal edge of its associated base member toward its associated profile and at least one of said male and female base member product side webs having disposed, on the surface from which its profile extends, a heat resistant barrier, whereby when said male and female profiles are engaged said product side webs are face to face, said heat resistant barrier being resistant to permitting said product side webs sealing to each other;

wherein at least one of said male and female product side webs is electrostatically charged to attract the other product side web.

2. The zipper in accordance with claim 1 wherein each of said male and female base member consumer side webs extends substantially to the same extent from a consumer side longitudinal edge of its associated base member toward its associated profile, at least one of said consumer side webs having disposed on the surface from which its profile extends a heat resistant barrier, whereby when said male and female profiles are engaged said consumer side webs are face to face, said heat resistant barrier being resistant to permitting said consumer side webs sealing to each other.

3. The zipper in accordance with claim 2 wherein said male profile and female profile each have two interengaging elements.

4. The zipper in accordance with claim 2 wherein said male and female profiles are configured to disengage from one another when engaged and subjected to a force of substantially 800 grams applied from the product side of the zipper.

5. The zipper in accordance with claim 2 wherein each of said male and female base member consumer side webs has a heat resistant barrier on the surface from which its profile extends.

6. The zipper in accordance with claim 1 wherein each of said male and female base member product side webs has a heat resistant barrier on the surface from which its profile extends.

7. A reclosable package comprising:

a first wall;

a second wall opposite to said first wall;

a thermoplastic zipper male base member disposed at a top end of said first wall and having a male profile extending transversely across said first wall, said male profile being disposed between a product side web and a consumer side web;

a thermoplastic zipper female base member disposed at a top end of said second wall and having a female profile extending transversely across said second wall, said female profile being disposed between a product side web and a consumer side web, said male and female product side webs, profiles and consumer side webs being, respectively, opposite to each other;

a heat resistant barrier on a surface of at least one of said male and female product side webs, said heat resistant barrier extending from a product side longitudinal edge of said at least one of said male and female base members, and surfaces of said male and female product side webs being heat sealed to said first and second walls, respectively; and, wherein at least one of said male and female product side webs is electrostatically charged to attract the other product side web.

8. The package in accordance with claim 7 wherein said package walls are formed of a laminated plastic film material.

9. The package in accordance with claim 8 wherein at least one of said male and female consumer side webs has a heat resistant barrier on a surface directed toward the other of said consumer side webs extending from a consumer side longitudinal edge toward its associated profile;

surfaces of said male and female consumer side webs being heat sealed to said first and second walls, respectively, and said first and second walls being heat sealed to each other above said consumer side longitudinal edge.

10. The package in accordance with claim 8 wherein said male profile and female profile each have two interengaging elements, one on a product side of said profiles and the other at a consumer side of said profiles.

11. The package in accordance with claim 10 wherein the force required to disengage the male and female profiles, when applied from the product side of the zipper, is substantially equal to the force required to de-laminate the laminated plastic film material from which the bag walls are formed.

12. The package in accordance with claim 10 wherein said laminated plastic film material delaminates when subjected to a force of substantially 800 grams.

13. The package in accordance with claim 7 wherein said male profile and female profile each have two interengaging elements.

14. A reclosable package comprising:

a first wall formed of a laminated plastic film material;

a second wall opposite to said first wall formed of said laminated plastic film material, said first wall and second wall being joined at a top seal of said package;

a thermoplastic zipper male base member disposed at a top end of said first wall and having a male profile extending transversely across said first wall, said male profile being disposed between a product side web and a consumer side web;

a thermoplastic zipper female base member disposed at a top end of said second wall and having a female profile extending transversely across said second wall, said female profile being disposed between a product side web and a consumer side web, said male and female product side webs, profiles and consumer side webs being, respectively, opposite to each other, a heat resistant barrier on a surface of at least one of said male and female product side webs, wherein said male base member product side web and a consumer side web are sealed to a surface of said first wall and said female base member product side web and a consumer side web are sealed to a surface of said second wall; and wherein the force required to disengage the male and female profiles, when applied from the product side of the zipper, is substantially equal to the force required to de-laminate at said top seal, the plastic film material from which the bag walls are formed.

* * * * *